US011245979B1

(12) United States Patent
Chusseau et al.

(10) Patent No.: US 11,245,979 B1
(45) Date of Patent: Feb. 8, 2022

(54) STIFFENING PART FOR AN AUDIO SPEAKER CASING

(71) Applicant: SAGEMCOM BROADBAND SAS, Rueil Malmaison (FR)

(72) Inventors: Hugo Chusseau, Rueil Malmaison (FR); Gilles Bourgoin, Rueil Malmaison (FR)

(73) Assignee: SAGEMCOM BROADBAND SAS, Rueil Malmaison (FR)

( * ) Notice: Subject to any disclaimer, the term of this patent is extended or adjusted under 35 U.S.C. 154(b) by 0 days.

(21) Appl. No.: 17/295,552

(22) PCT Filed: Nov. 14, 2019

(86) PCT No.: PCT/EP2019/081406
§ 371 (c)(1),
(2) Date: May 20, 2021

(87) PCT Pub. No.: WO2020/114750
PCT Pub. Date: Jun. 11, 2020

(30) Foreign Application Priority Data

Dec. 3, 2018 (FR) ..... 1872244

(51) Int. Cl.
*H04R 1/28* (2006.01)

(52) U.S. Cl.
CPC ..... *H04R 1/2896* (2013.01)

(58) Field of Classification Search
CPC ..... H04R 1/025; H04R 1/08; H04R 1/403; H04R 1/02; H04R 1/028; H04R 1/2896;
(Continued)

(56) References Cited

U.S. PATENT DOCUMENTS 3,393,764 A * 7/1968 Schafer ..... H04B 1/22 381/89
4,797,935 A * 1/1989 Tanaka ..... H04R 1/2896 181/171
(Continued)

FOREIGN PATENT DOCUMENTS

FR 2746246 A1 9/1997

*Primary Examiner* — Ahmad F. Matar
*Assistant Examiner* — Sabrina Diaz
(74) *Attorney, Agent, or Firm* — Muncy, Geissler, Olds & Lowe, P.C.

(57) ABSTRACT

A stiffening part (25) arranged to be integrated into the interior of a casing (12) of an audio speaker (11) in order to stiffen said casing, the audio speaker also being capable of comprising at least one loudspeaker (18*a*) mounted on a first face (14) of the casing, the stiffening part comprising a connecting portion, at least one damping support defining a receiving space arranged to receive a damping device (40*a*) for intended to limit vibrations of the loudspeaker, wherein the damping support comprises a plurality of ribs (34) distributed around the receiving space (31), each rib extending in a distinct plane parallel to a depth of the receiving space, the stiffening part being arranged such that, when the enclosure (11) is assembled, the connecting portion interconnects inner walls of a second (15) of the casing and a third face (16) of the casing opposite each other and both perpendicular to the first face (14), the damping device being positioned in the receiving space, and a rear portion of the loudspeaker abutting the damping device.

14 Claims, 5 Drawing Sheets

(58) Field of Classification Search
CPC ..... H04R 1/026; H04R 2499/11; H04R 2499/15; H04R 2201/021; H04R 2201/023; H04R 2201/02; H04R 2201/029; H04R 5/02; H04R 5/023; H04R 2205/021; B60R 11/0217; B60R 2011/0045; H04S 7/40
USPC ..... 381/332, 87, 334
See application file for complete search history.

(56) References Cited

U.S. PATENT DOCUMENTS

| | | | | | |
|---|---|---|---|---|---|
| 4,805,221 | A * | 2/1989 | Quaas | H04R 1/02 | 181/166 |
| 4,939,783 | A * | 7/1990 | Dunning | H04R 1/2873 | 181/150 |
| 6,678,384 | B2 * | 1/2004 | Kowaki | H04R 1/2896 | 381/182 |
| 7,221,772 | B2 * | 5/2007 | Evenisse | H04R 1/025 | 381/386 |
| 7,292,706 | B2 * | 11/2007 | Hamada | H04R 1/025 | 381/386 |
| 7,970,160 | B2 * | 6/2011 | Hiramoto | H04R 1/021 | 381/397 |
| 8,201,659 | B2 * | 6/2012 | Imai | H04R 1/2811 | 181/146 |
| 9,743,192 | B2 * | 8/2017 | Shibata | H02K 33/18 | |
| 2008/0279413 | A1 | 11/2008 | Roemer et al. | | |
| 2018/0184197 | A1 * | 6/2018 | Kwolek | H04R 1/028 | |

* cited by examiner

STIFFENING PART FOR AN AUDIO SPEAKER CASING

The invention relates to the field of stiffener parts for speaker enclosure cabinets.

BACKGROUND OF THE INVENTION

A speaker enclosure comprises a cabinet and one or more loudspeakers. Or more faces of the cabinet include one or more openings, each for the purpose of receiving a respective loudspeaker.

In a speaker enclosure, movement of the loudspeaker diaphragms gives rise to vibration that produces interfering noise.

With reference to FIGS. 1 and 2, a prior art enclosure 1 comprises a cabinet 2 having a top face, a bottom face, and side faces. The enclosure also includes a first loudspeaker 3*a* mounted against the top face and a second loudspeaker 3*b* mounted against the bottom face of the cabinet 2. In operation, the loudspeakers 3 excite three modes of vibration of the enclosure 1.

A first mode of vibration results from pumping movement of the magnets 4 of the loudspeakers 3. The magnet 4 of each loudspeaker 3 is subjected to movement in translation along the translation axis X1 (see FIG. 1), which is a longitudinal axis of the enclosure 1. This movement in translation is due to the relatively large mass of each magnet 4 and to the relative flexibility of the sheet 5 of the loudspeaker 3, referred to as the "basket", in which the diaphragm (not referenced) extends. The movement in translation takes place in the direction of operation of the diaphragm of the loudspeaker 3.

A second mode of vibration results from rocking movement of the magnets 4 of the loudspeakers 3. The magnet 4 of each loudspeaker 3 is subjected to rocking movement about a rocking axis X2 that passes through the center of the diaphragm and that is perpendicular to the longitudinal axis of the loudspeaker 3 (see FIG. 2). This rocking movement is likewise due to the relatively large mass of the magnet 4 and to the relative flexibility of the sheet of the loudspeaker 3.

A third mode of vibration results from deformation of the cabinet 2 of the enclosure 1, which "swells" as a result of the rise of internal pressure induced by the movement of the diaphragms of the loudspeakers 3.

OBJECT OF THE INVENTION

An object of the invention is to reduce the vibration and thus the interfering noise of a speaker enclosure.

SUMMARY OF THE INVENTION

In order to achieve this object, there is provided a stiffener part arranged to be incorporated inside a cabinet of a speaker enclosure in order to stiffen said cabinet, the speaker enclosure also being capable of containing at least one loudspeaker mounted against a first face of the cabinet, the stiffener part comprising a connection portion and at least one damper support defining a reception space arranged to receive a damper device for limiting vibration of the loudspeaker, the damper support including a plurality of splines distributed around the reception space, each spline extending in a distinct plane parallel to a depth dimension of the reception space, the stiffener part being arranged in such a manner that, when the enclosure is assembled, the connection portion connects together the inside walls of mutually opposite second and third faces of the cabinet that are both perpendicular to the first face, the damper device is positioned in the reception space, and a rear portion of the loudspeaker comes to bear against the damper device.

The connection portion, which connects together the second and third faces of the cabinet, the splines, and the damper device positioned in the reception space serve to limit the above-mentioned modes of vibration. By means of the stiffener part of the invention, the three main resonant frequencies of the enclosure are shifted away from the utilization range of the loudspeaker, and the interfering noise is reduced very considerably.

There is also provided an enclosure comprising a cabinet, a loudspeaker, the above-described stiffener part, and a damper device.

The invention can be better understood in the light of the following description of a particular, nonlimiting embodiment of the invention.

BRIEF DESCRIPTION OF THE DRAWINGS

Reference is made to the accompanying drawings, in which.

DETAILED DESCRIPTION OF THE INVENTION

Figure 2:
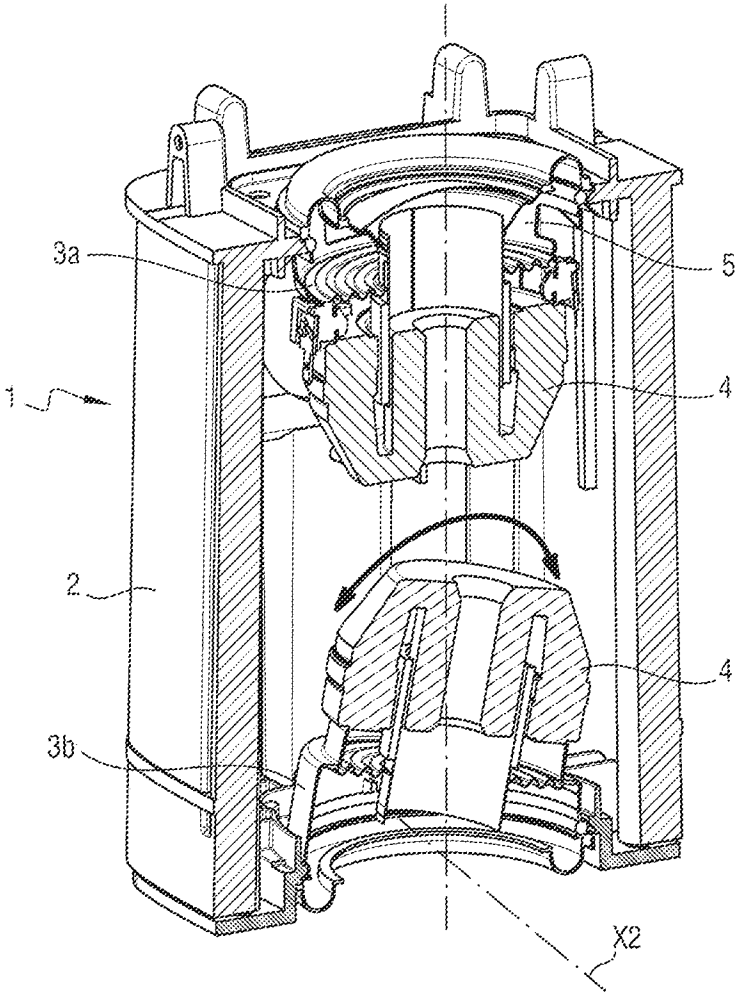
FIG. 2 is a view analogous to the view of FIG. 1, with one of the loudspeakers being subjected to rocking movement.
Figure 1:
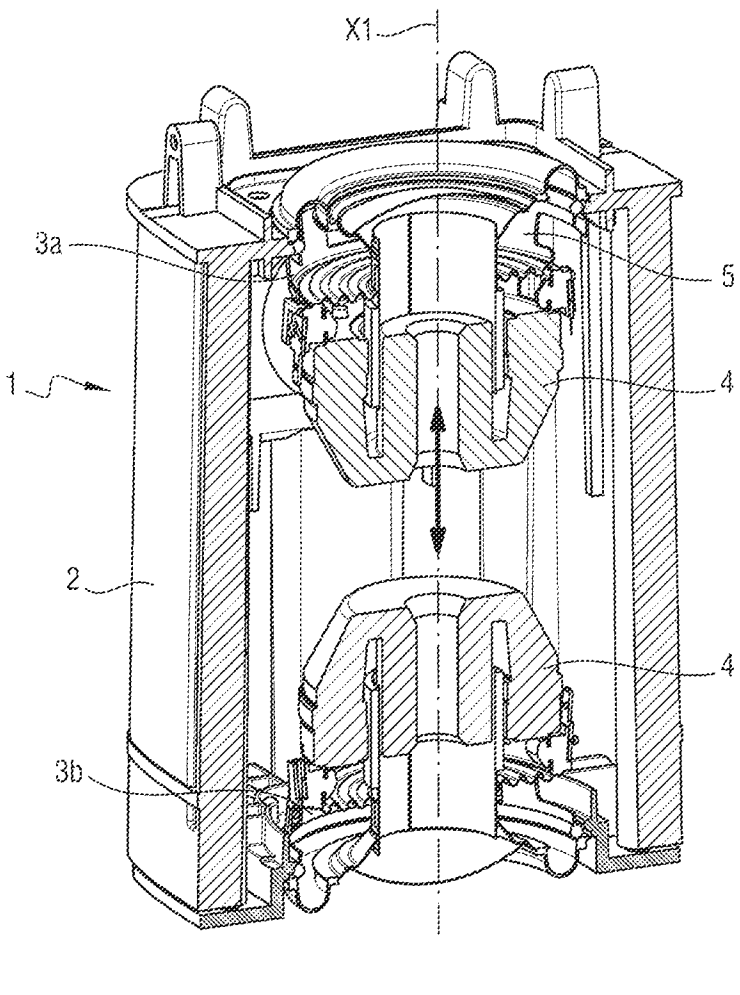
FIG. 1 is a perspective view of a cabinet and of two loudspeakers of a prior art enclosure, the view being in section on a plane parallel to the longitudinal axis of the enclosure.
Figure 3:
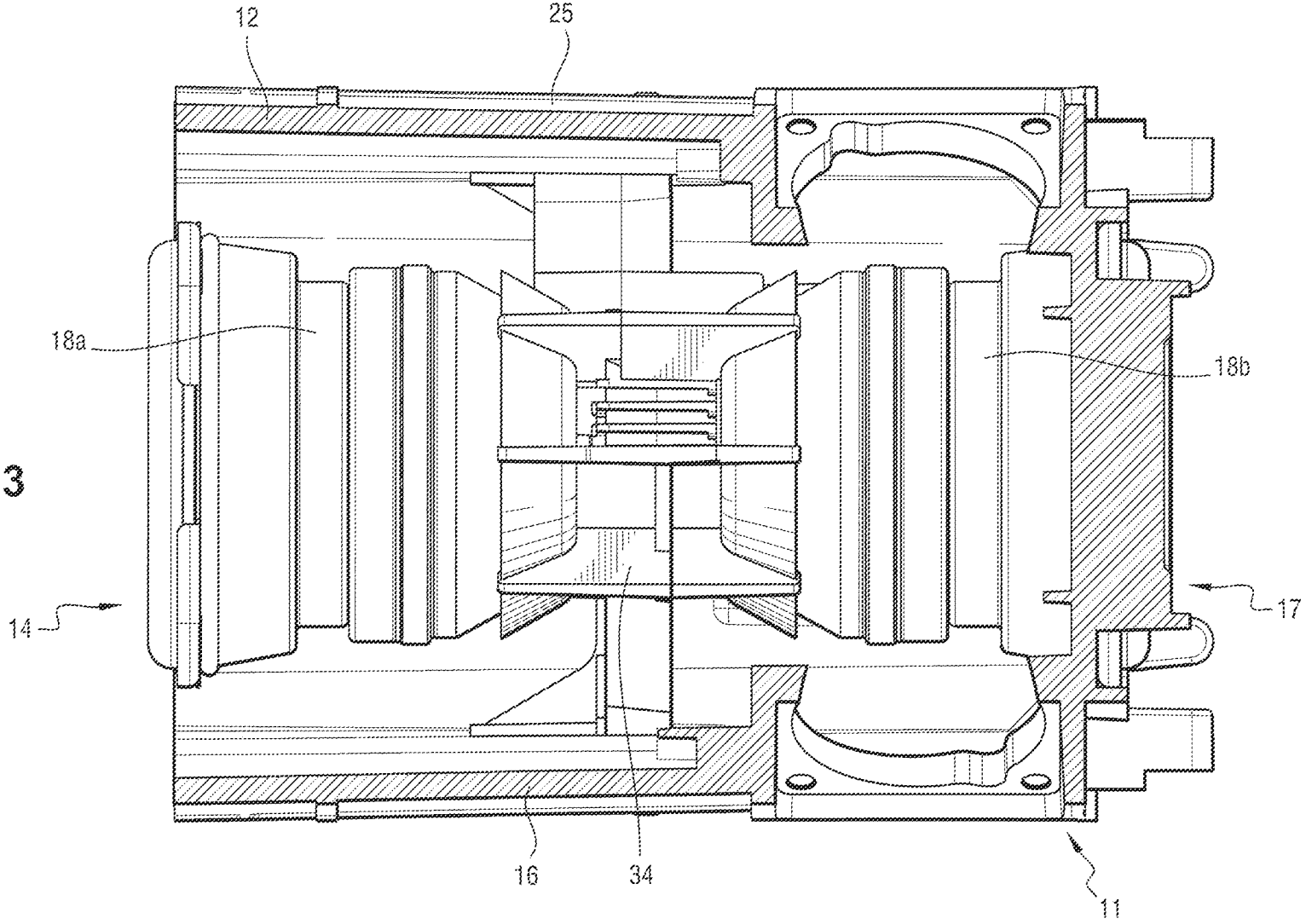
FIG. 3 is a perspective view of an enclosure comprising a cabinet, two loudspeakers, two damper devices, and a stiffener part of the invention.
Figure 4:
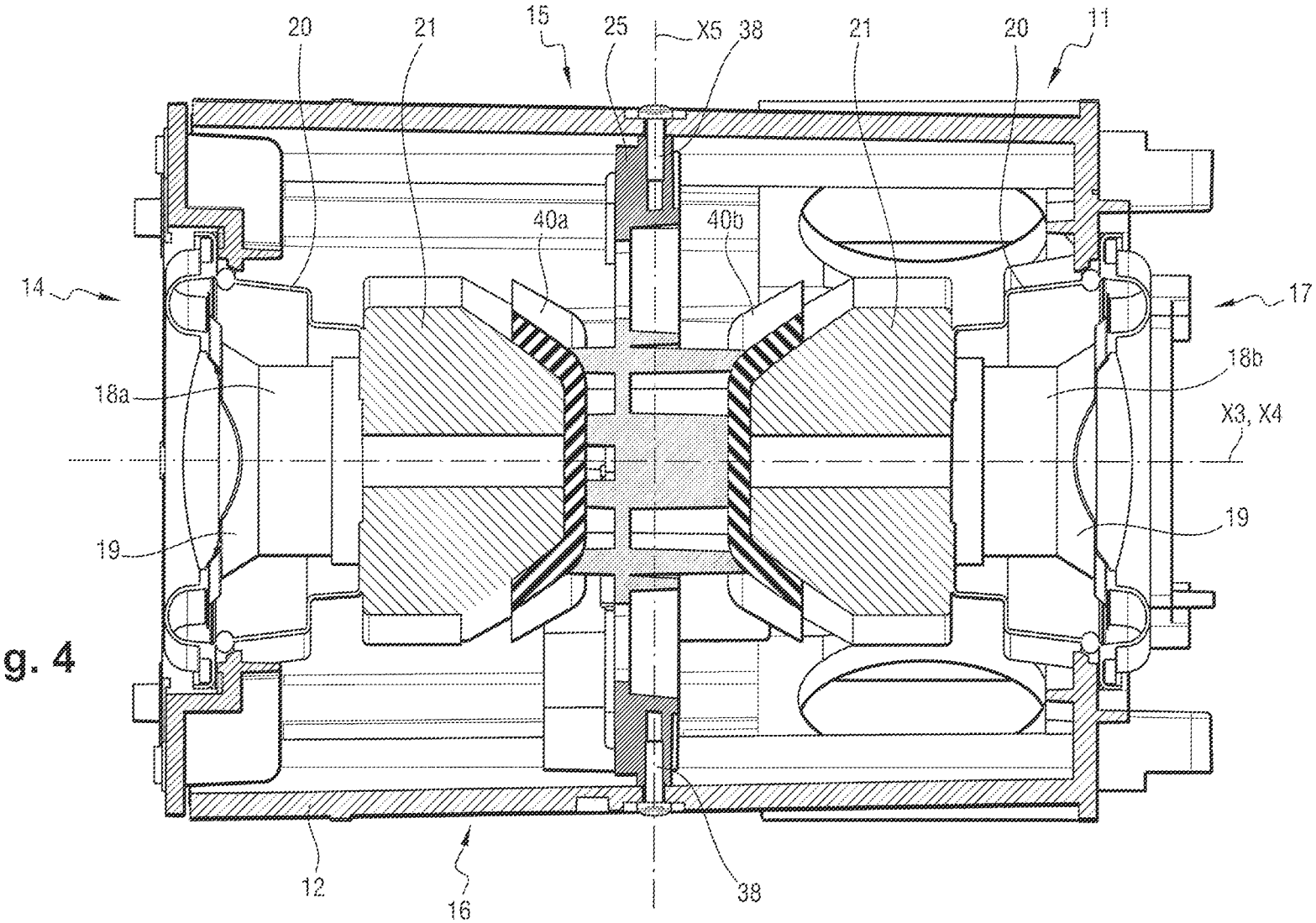
FIG. 4 is a view similar view of FIG. 3, the view being in section on a plane parallel to a longitudinal axis of the enclosure.

With reference to FIGS. 3 and 4, and in this example, the invention is implemented in a speaker enclosure 11, which is specifically a smart speaker.

The enclosure 11 comprises mainly a cabinet 12 and a plurality of loudspeakers.

The outside shape of the cabinet 12 is generally that of a rectangular box. The cabinet 12 has a top face, referred to herein as the "first" face 14, four side faces, including two opposite faces (i.e. faces situated facing each other) that are referred to herein as the "second" face 15 and as the "third" face 16, and a bottom face, referred to herein as the "fourth" face 17.

Thus, the first face 14 and the fourth face 17 are two opposite faces, both of which are perpendicular to the second face 15 and to the third face 16.

Herein, the term "longitudinal axis of the cabinet" refers to the axis X3 that passes through the centers of the first face 14 and of the fourth face 17.

The plurality of loudspeakers comprises a first loudspeaker 18*a* and a second loudspeaker 18*b*, together with other loudspeakers that are not described herein.

In this example, each of the first and second loudspeakers 18*a* and 18*b* comprises a diaphragm 19, a sheet 20 referred to as a "basket" in which the diaphragm 19 extends, a coil, and a magnet 21. In this example, each magnet 21 is frustoconical in shape, of radius that decreases going towards the rear of the loudspeaker 18. Herein, the term "front portion" of each loudspeaker 18 designates the portion that includes the diaphragm 19, and the term "rear portion" designates the portion remote from the diaphragm 19. In this example, the rear portion thus comprises the magnet 21. Herein, the term "loudspeaker longitudinal axis" X4 designates the axis of revolution of the magnet 21 that also passes through the center of the diaphragm 19, and the "height" of the loudspeaker 18 is the dimension of the loudspeaker 18 along its longitudinal axis X4.

The first loudspeaker 18*a* is mounted in the first face 14 of the cabinet 12. The first loudspeaker 18*a* is fastened to the first face 14, with the longitudinal axis X4 of the first loudspeaker 18*a* being perpendicular to the first face 14. The first face 14 presents an opening of shape that coincides with the circumference of the large diameter of the diaphragm 19 of the first loudspeaker 18*a* and into which the diaphragm 19 opens out.

The second loudspeaker 18*b* is mounted in the same manner against the fourth face 17 of the cabinet 12.

The first and second loudspeakers 18*a* and 18*b* are thus mounted back-to-back in the cabinet 12, and their longitudinal axes X4 coincide. The longitudinal axes X4 of the first and second loudspeakers 18*a* and 18*b* are parallel with the longitudinal axis X3 of the cabinet 12.

Figure 5:
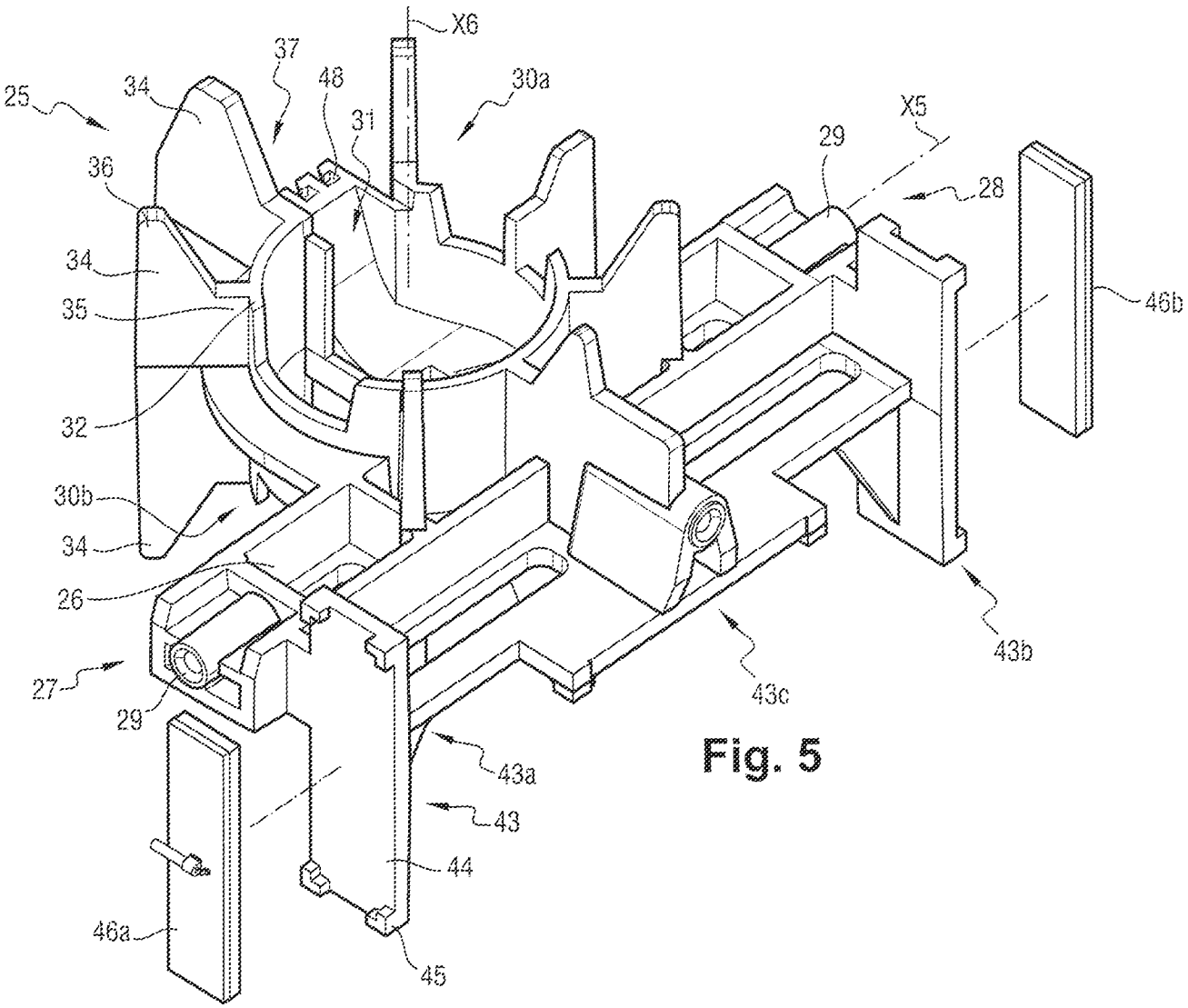
FIG. 5 is a perspective view of the stiffener part of the invention.

With reference to FIG. 5, the enclosure also comprises a stiffener part 25 incorporated inside the cabinet 12.

The stiffener part 25 is positioned between the first and second loudspeakers 18*a* and 18*b*.

The stiffener part 25 is made out of a thermoplastic material.

The stiffener part 25 comprises firstly a connection portion 26 (that might also be referred to as a "beam").

The connection portion 26 connects together the inside wall of the second face 15 and the inside wall of the third face 16. When the stiffener part 25 is in position in the cabinet 12, the connection portion 26 extends lengthwise along a connection axis X5 that is parallel to a transverse axis of the cabinet 12 and is orthogonal to the longitudinal axis X3 of the cabinet 12. The connection portion thus extends parallel to the first and fourth faces 14 and 17 of the cabinet 12.

In this example, the connection portion 26 has a first end 27 and a second end 28, each of which is provided with fastener means for fastening to a respective face of the cabinet 12, specifically a tapped hole 29 in this example. The first end 27 of the connection portion 26 is screw fastened to the second face 15 of the cabinet 12, while the second end 28 of the connection portion 26 is screw fastened to the third face 16 of the cabinet 12. A first screw 38 (visible in FIG. 4) thus extends through the second face 15 in order to be screwed into the tapped hole 29 of the first end 27, and a second screw 38 extends through the third face 16 in order to be screwed into the tapped hole 29 of the second end 28 of the connection portion 26.

The stiffener part 25 also includes a first damper support 30*a* and a second damper support 30*b*.

The first and second damper supports 30*a* and 30*b* are situated in a central portion of the connection portion 26.

The first damper support 30*a* is described initially.

The first damper support 30*a* defines a reception space 31 having the general shape of a volume of revolution, specifically a frustoconical shape. The axis of revolution X6 of the reception space 31 is orthogonal to the connection axis X5 of the connection portion 26.

The radius of the reception space 31 is small at an end wall 32 of the reception space 31, and it increases going towards the main opening of the reception space 31, which extends facing the end wall 32 of the reception space 31.

The first damper support 30*a* includes splines 34 that are distributed at different orientations around the reception space 31. Each spline 34 is in the shape of a fin. The splines 34 extend radially around the reception space 31 from the circumference of the reception space 31. The length of each spline is parallel to the axis of revolution X6 of the reception space 31, and the width of each spline 34 is defined in the direction extending a radius of the reception space 31. Each spline 34 extends in a distinct plane parallel to a depth of the reception space 31, i.e. in this example parallel to the axis of revolution X6 of the reception space 31.

Each spline 34 has a base 35 that is situated level with the end wall 32 of the reception space 31, and a free end 36. Each spline 34 presents a setback 37 formed facing the reception space 31, such that the width of each spline 34 decreases going away from the base 35 of the spline 34 towards the free end 36 of the spline 34. The frustoconical shape of the reception space 31 is defined by the setbacks 37 formed in the splines 34.

The second damper support 30*b* presents the same shape as the first damper support 30*a*. The reception spaces 31 of the first and second damper supports 30*a* and 30*b* have coinciding axes of revolution X6, such that when looking along the axis of revolution X6, the first and second damper supports 30*a* and 30*b* are superposed. The splines 34, of the first damper support 30*a* are defined in continuity with and extending the splines 34 of the second damper support 30*b*: they are the same splines 34 each having one half of the spline belonging to the first damper support 30*a* and its other half belonging to the second damper support 30*b*.

The first damper support 30*a* and the second damper support 30*b* are nevertheless arranged back-to-back on opposite sides of the connection axis X5 of the connection portion 26: the end wall 32 of the reception space 31 of the first damper support 30*a* is situated against the end wall of the reception space 31 of the second damper support 30*b*, or at least in its proximity.

The reception space 31 of the first damper support 30*a* is for receiving a damper device 40*a*, and the reception space 31 of the second damper support 30*b* is for receiving a damper device 40*b*.

Each damper device 40 is made out of a flexible material, and in this example out of an elastomer material.

Figure 6:
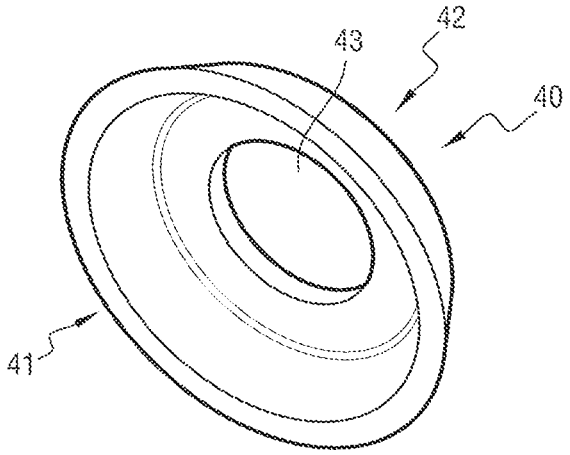
FIG. 6 is a perspective view of a damper device.

With reference to FIG. 6, each damper device 40 presents an outside shape that is frustoconical and thickness that is relatively small. The large radius face 41 of the damper device 40 is completely open, whereas the small radius face 42 of the damper device 40 is closed in part, while presenting a central opening 43. The central opening 43 allows the masses of air that are moved by the movement of the diaphragm 19 to be admitted and exhausted.

The enclosure 11 is assembled as follows. The stiffener part 25 is fastened in the cabinet 12. A damper device 40*a* is placed in the reception space 31 of the first damper support 30*a*. A damper device 40*b* is placed in the reception space 31 of the second damper support 30*b*. The first loudspeaker 18*a* is fastened against the first face 14 of the cabinet 12 and the second loudspeaker 18*b* is fastened against the fourth face 17 of the cabinet 12. Thereafter, the first loudspeaker 18*a*, the first face 14, the second loudspeaker 18*b*, and the fourth face 17 are mounted on the remainder of the cabinet 12.

Once the enclosure 11 is assembled, the connection portion 26 of the stiffener part 25 connects together the inside walls of the second and third faces 15 and 16 of the cabinet 12. The rear portion of the first loudspeaker 18*a* comes to bear against the damper device 40*a* positioned in the reception space 31 of the first damper support 30*a*. The rear portion of the second loudspeaker 18*b* comes to bear against the damper device 40*b* positioned in the reception space 31 of the second damper support 30*b*.

The splines 34 of the first and second damper supports 30*a* and 30*b* are all perpendicular to the first and fourth faces 14 and 17 of the cabinet 12, and they are all parallel to the longitudinal axis X3 of the cabinet 12.

The stiffener part 25, which has its ends fastened to the cabinet 12, serves to stiffen the cabinet 12.

The stiffener part 25 is structured by the splines 34, which also serve to stiffen the cabinet 12. The splines 34 prevent inflation deformation of the cabinet 12 caused by internal pressure variation due to the movements of the diaphragms 19 of the first and second loudspeakers 18*a* and 18*b*.

The damper devices 40 serve to limit significantly the pumping of the magnets 21 of the first and second loudspeakers 18*a* and 18*b*, i.e. to limit the movements in translation of the magnets 21. The damper devices 40 also limit considerably the rocking of the magnets 21 about the rocking axis X2.

Using the stiffener part 25 thus serves to shift the three main resonant frequencies of the enclosure 11 away from the utilization range of the first and second loudspeakers 18*a* and 18*b* (and of the other loudspeakers of the enclosure 11), i.e. in this example beyond 300 hertz (Hz). A simple assembly of a part made of plastics material and two elastomer washers, thus enables the stiffener part 25 to eliminate the sources of vibration in the enclosure 11 that give rise to interfering noise.

It should be observed that the stiffener part 25 includes a plurality of card supports 43. Each card support 43 comprises a plane surface 44 of rectangular shape together with four corners 45.

In particular, there is a first card support 43*a* situated at the first end 27 of the connection portion 26 and a second card support 43*b* situated at the second end 28 of the connection portion 26.

When the stiffener part 25 is mounted in the cabinet 12, the plane surface 44 of the first card support 43*a* is parallel to the second face 15 of the cabinet 12 and it is situated facing the second face 15 and in its proximity. The plane surface 44 of the second card support 43*b* is parallel to the third face 16 of the cabinet 12 and is situated facing the third face 16 and in its proximity.

The first card support 43*a* is arranged to receive a first electric circuit card 46*a*, which card is positioned against the plane surface 44 of the first card support 43*a* and is held in position between the four corners 45. The first circuit card is fastened to the first card support 43*a*.

In this example, the first circuit card 46*a* includes a Wi-Fi antenna that does not interact with the loudspeakers.

The second card support 43*b* is arranged to receive a second electric circuit card 46*b*, which card is positioned against the plane surface 44 of the second card support 43*b* and is held in position between the four corners 45. The second circuit card 46*b* is fastened to the second card support 43*b*.

In this example, the second circuit card 46*b* includes a Wi-Fi antenna that does not interact with the loudspeakers.

There is also a third card support 43*c* positioned in the central portion of the connection portion 26.

Grooves 48 are formed in the damper supports 30 of the stiffener part 25. Electric wires connected to the first and second circuit cards 46*a* and 46*b* pass via the grooves 48. The grooves 48 serve both to hold these electric wires in position and also to protect them.

Thus, it can be seen that in addition to its role of stiffening and supporting damper devices 40, the stiffener part 26 also serves to incorporate and to protect circuit cards 46 and wires inside the cabinet 12 in effective and inexpensive manner.

Naturally, the invention is not limited to the embodiment described, but covers any variant coming within the ambit of the invention as defined by the claims.

The loudspeaker(s) cooperating with the stiffener part need not necessarily be mounted against a top or bottom face of the cabinet.

The shapes of the elements described could be different. In particular, the magnet of each loudspeaker could be of a different shape (annular, cylindrical, etc.), as indeed could the reception space of each support.

The rear portion of the loudspeaker, which is in contact with the damper device, need not necessarily be the magnet, but could be any other element situated at the rear of the loudspeaker: part of its motor, a part secured to its basket, etc.

The damper device(s) could be different from those described above. The damper devices could be incorporated in the stiffener part, for example they could be molded thereon.

The stiffener part could form part of the cabinet and could be formed integrally therewith (or at least with the second and/or third face of the cabinet). It should also be observed that, when it is said that the connection portion connects together the inside walls of the second and third faces of the cabinet, that does not necessarily mean that the connection portion is fastened directly to the inside walls: the connection portion could be fastened to any parts that are themselves secured to the inside walls.

The invention claimed is:

1. A stiffener part arranged to be incorporated inside a cabinet of a speaker enclosure in order to stiffen said cabinet, the speaker enclosure also being capable of containing at least one loudspeaker mounted against a first face of the cabinet, the stiffener part comprising a connection portion and at least one damper support defining a reception space arranged to receive a damper device for limiting vibration of the loudspeaker, the damper support comprising a plurality of splines distributed around the reception space, each spline extending in a distinct plane parallel to a depth dimension of the reception space, the stiffener part being arranged in such a manner that, when the enclosure is assembled, the connection portion connects together inside walls of mutually opposite second and third faces of the cabinet that are both perpendicular to the first face, the damper device is positioned in the reception space, and a rear portion of the loudspeaker comes to bear against the damper device.

2. The stiffener part according to claim 1, wherein the reception space presents the general shape of a volume of revolution, and wherein the splines project radially around the reception space.

3. The stiffener part according to claim 1, wherein each spline is in the form of a fin.

4. The stiffener part according to claim 1, wherein the shape of the reception space is defined by setbacks formed in the splines and facing the reception space.

5. The stiffener part according to claim 1, wherein each spline presents a width that decreases between a base of the spline and a free end of the spline, such that the reception space presents a shape that is frustoconical.

6. The stiffener part according to claim 1, wherein the connection portion presents two ends that include respective fastener means for fastening the stiffener part to the second and third faces of the cabinet.

7. The stiffener part according to claim 1, wherein the stiffener part is made out of a thermoplastic material.

8. The stiffener part according to claim 1, wherein the enclosure is capable of containing at least a first loudspeaker mounted against the first face of the cabinet and a second loudspeaker mounted against a fourth face of the cabinet that is opposite the first face, the first and second loudspeakers being mounted back-to-back, the stiffener part including a first damper support and a second damper support that are arranged back-to-back.

9. The stiffener part according to claim 1, further comprising at least one card support on which an electric circuit card can be fastened.

10. The stiffener part according to claim 9, comprising two card supports, each presenting a respective plane surface and each being situated at a respective end of the connection portion.

11. The stiffener part according to claim 9, further including grooves arranged so that wires connected to the electric card pass along the grooves.

12. An enclosure comprising a cabinet, a loudspeaker, a stiffener part according to claim 1, and a damper device.

13. The enclosure according to claim 12, wherein the damper device is made out of an elastomer material.

14. The enclosure according to claim 12, comprising the stiffener part, a first loudspeaker mounted against a first face of the cabinet, a second loudspeaker mounted against a fourth face of the cabinet, together with two damper devices, the first loudspeaker and the second loudspeaker being mounted back-to-back in the enclosure, the stiffener part including a first damper support and a second damper support that are arranged back-to-back.

* * * * *